US005236626A

United States Patent [19]

Vanderpool et al.

[11] Patent Number: 5,236,626

[45] Date of Patent: Aug. 17, 1993

[54] ALKOXYBENZOTRIAZOLE COMPOSITIONS AND THE USE THEREOF AS COPPER AND COPPER ALLOY CORROSION INHIBITORS

[75] Inventors: Daniel P. Vanderpool, Coraopolis; Charles Y. Cha, McMurray, both of Pa.

[73] Assignee: Calgon Corporation, Pittsburgh, Pa.

[21] Appl. No.: 989,865

[22] Filed: Dec. 14, 1992

Related U.S. Application Data

[62] Division of Ser. No. 587,192, Sep. 24, 1990.

[51] Int. Cl.[5] ..... C23F 11/00

[52] U.S. Cl. ..... 252/394; 210/696; 210/698; 252/395; 252/396; 252/405; 252/406; 252/407; 422/14; 422/16

[58] Field of Search ..... 210/696, 698; 252/390, 252/392, 394, 396, 401, 403, 405, 407; 422/14, 16

[56] References Cited

U.S. PATENT DOCUMENTS

| | | | |
|---|---|---|---|
| 2,861,078 | 11/1958 | Miller et al. | 548/257 |
| 3,887,481 | 6/1975 | Korpics | 422/16 |
| 4,338,209 | 7/1982 | Manabe et al. | 252/391 |
| 4,363,913 | 12/1982 | Clark et al. | 548/164 |
| 4,363,914 | 12/1982 | Long et al. | 548/257 |
| 4,406,811 | 9/1983 | Christensen et al. | 252/180 |
| 4,497,713 | 2/1985 | Geiger | 422/15 |
| 4,675,158 | 6/1987 | Klindera | 252/391 |
| 4,744,950 | 5/1988 | Hollander | 422/16 |
| 4,873,139 | 10/1989 | Kinosky | 428/341 |

FOREIGN PATENT DOCUMENTS

| | | |
|---|---|---|
| 0397450 | 11/1990 | European Pat. Off. . |
| 0397454 | 11/1990 | European Pat. Off. . |

OTHER PUBLICATIONS

Chemical Abstracts, vol. 102, No. 18, Abstract No. 153153b.

Patent Abstracts of Japan, vol. 6, No. 94 (C-105) (972).

Chemical Abstract 95(6):47253m-Inhibitor for Corrosion of Carbon Steel in Nitric Acid.

*Primary Examiner*—Robert L. Stoll

*Assistant Examiner*—Valerie Fee

*Attorney, Agent, or Firm*—W. C. Mitchell; C. M. Caruso

[57] ABSTRACT

An alkoxybenzotriazole, in combination with mercaptobenzothiazole, tolyltriazole, benzotriazole, a substituted benzotriazole and/or 1-phenyl-5-mercaptotetrazole, is used to inhibit the corrosion of metallic surfaces, particularly copper surfaces, in contact with an aqueous system. Systems and compositions are also claimed.

5 Claims, No Drawings

ALKOXYBENZOTRIAZOLE COMPOSITIONS AND THE USE THEREOF AS COPPER AND COPPER ALLOY CORROSION INHIBITORS

This is a division of application Ser. No. 587,192, filed Sep. 24, 1990, pending.

BACKGROUND OF THE INVENTION

Benzotriazole, mercaptobenzothiazole and tolyltriazole are well known copper corrosion inhibitors. For example, see U.S. Pat. No. 4,675,158 and the references cited therein. This patent discloses the use of tolyltriazole/mercaptobenzothiazole compositions as copper corrosion inhibitors. Also, see U.S. Pat. No. 4,744,950, which discloses the use of lower ($C_3$–$C_6$) alkylbenzotriazoles as corrosion inhibitors, and corresponding EPO application No. 85304467.5.

U.S. Pat. No. 4,338,209 discloses metal corrosion inhibitors which contain one or more of mercaptobenzothiazole, tolyltriazole and benzotriazole. Examples of formulations containing benzotriazole and tolyltriazole and formulations containing mercaptobenzothiazole and benzotriazole are given.

Copending patent application U.S.S.N. 348,521 relates to the use of higher alkylbenzotriazoles as copper and copper alloy corrosion inhibitors, copending patent application U.S.S.N. 348,532 relates to the use of alkoxybenzotriazoles as copper and copper alloy corrosion inhibitors, and copending patent application U.S.S.N. 540,977 relates to the use of alkylbenzotriazole/mercaptobenzothiazole, tolyltriazole, benzotriazole and/or phenyl mercaptotetrazole compositions as copper and copper alloy corrosion inhibitors.

U.S. Pat. No. 4,406,811 discloses compositions containing a triazole such as tolyltriazole, benzotriazole or mercaptobenzothiazole, an aliphatic mono- or di-carboxylic acid and a nonionic wetting agent.

U.S. Pat. No. 4,363,913 discloses a process for preparing 2-aminobenzothiazoles and alkyl and alkoxy-substituted aminobenzothiazoles.

U.S. Pat. No. 2,861,078 discloses a process for preparing alkyl and alkoxy-substituted benzotriazoles.

U.S. Pat. No. 4,873,139 discloses the use of 1-phenyl-1H-tetrazole-5-thiol to prepare corrosion-resistant silver and copper surfaces. The use of 1-phenyl-5-mercaptotetrazole to inhibit the corrosion of carbon steel in nitric acid solutions is also known. See Chemical Abstract CA 95(6):47253 (1979).

The present invention relates to alkoxybenzotriazole compositions comprising a) a $C_3$–$C_{12}$ alkoxybenzotriazole; and b) a compound selected from the group consisting of mercaptobenzothiazole, tolyltriazole, benzotriazole, substituted benzotriazoles such as chlorobenzotriazole, nitrobenzotriazole, etc. and 1-phenyl-5-mercaptotetrazole, and salts thereof and the use thereof as corrosion inhibitors, particularly copper and copper alloy corrosion inhibitors. These compositions form long-lasting protective films on metallic surfaces, particularly copper and copper alloy surfaces, in contact with aqueous systems, and are especially effective in high-solids water. Additionally, these compositions generally provide improved tolerance to oxidizing biocides such as chlorine and bromine.

The use of the instant blends of $C_3$ to $C_{12}$ alkoxygenzotriazoles and one or more of mercaptobenzothiazole, tolyltriazole, benzotriazole and 1-phenyl-5-mercaptotetrazole or related compounds provides fast passivation, allows the use of lower concentrations of expensive alkoxybenzotriazoles for effective durable (persistent) film formation, provides stable, chemically resistent corrosion protection and overcomes problems relating to the failure to obtain passivation by alkoxybenzotriazoles alone in high-solids water. The instant admixtures also allow for intermittent feed to cooling water systems.

As used herein the term "passivation" refers to the formation of a film which lowers the corrosion rate of the metallic surface which is being treated. "Passivation rate" refers to the time required to form a protective film on a metallic surface, and "persistency" refers to the length of time a protective film is present on a metallic surface when a corrosion inhibitor is not present in an aqueous system which is in contact with the coated metallic surface. Also, the term "high solids water" refers to water which contains dissolved solids in excess of about 1,500 mg/L. Dissolved solids include, but are not limited to, anions released from chlorides, sulfates, silicates, carbonates, bicarbonates and bromides; and cations such as lithium, sodium, potassium, calcium and magnesium.

The instant alkoxybenzotriazole/tolyltriazole, benzotriazole, mercaptoenzothiazole and/or phenyl mercaptotetrazole compositions, or the use othereof for corrosion control, are not known or suggested in the art.

DESCRIPTION OF THE INVENTION

In its broadest sense, the instant invention is directed to compositions which comprise a) a $C_3$–$C_{12}$ alkoxybenzotriazole or salt thereof and b) a compound selected from the group consisting of tolyltriazole and salts thereof, benzotriazole and salts thereof, substituted benzotriazoles and salts thereof, mercaptobenzothiazole and salts thereof and phenyl mercaptotetrazole and its isomers and salts thereof. More particularly, the instant invention is directed to compositions comprising: a) a $C_3$–$C_{12}$ alkoxybenzotriazole or salt thereof and b) a compound selected from the group consisting of mercaptobenzothiazole, tolyltriazole, benzotriazole, substituted benzotriazoles including, but not limited to chlorobenzotriazole and nitrobenzotriazole, 1-phenyl-5-mercaptotetrazole, isomers of phenyl mercaptotetrazole and salts thereof, wherein the weight ratio of a):b), on an active basis, ranges from about 0.001:100 to about 100:1, preferably about 0.1:20 to about 20:1 and most preferably from about 0.1:10 to about 10:1. The instant invention is also directed to a method for inhibiting the corrosion of metallic surfaces, particularly copper and copper alloy surfaces, in contact with an aqueous system, comprising adding to the aqueous system being treated an effective amount of at least one of the above described compositions.

The instant invention is also directed to an aqueous system which is in contact with a metallic surface, particularly a copper or copper alloy surface, which contains an effective amount of at least one of the instant compositions.

Compositions comprising water, particularly cooling water, and the instant alkoxybenzotriazole compositions are also claimed.

The inventors have discovered that the instant alkoxybenzotriazole compositions are effective corrosion inhibitors, particularly with respect to copper and copper-containing metals. These compositions form durable, long-lasting (persistent) films on metallic surfaces, including but not limited to copper and copper alloy surfaces. Since the alkoxybenzotriazole compositions of this invention are especially effective inhibitors of copper and copper alloy corrosion, they can be used to protect multimetal systems, especially those containing copper or a copper alloy and one or more other metals.

The instant inventors have also discovered a surprising and beneficial interaction between 5-($C_3$ to $C_{12}$ alkoxy) benzotriazoles and one or more of substituted benzotriazoles, mercaptobenzothiazole, tolyltriazole, benzotriazole, 1-phenyl-5-mercaptotetrazole, isomers of 1-phenyl-5-mercaptotetrazole, and salts thereof. Aside from the fact that such compositions provide cost effective corrosion control in cooling water systems, these blends provide faster passivation rates than alkoxybenzotriazoles alone and are particularly effective when used to provide passivation in high-solids, aggressive water in which expensive alkoxybenzotriazoles alone may fail to passivate copper. Also, the instant compositions cause the formation of durable protective films, which have improved resistance to chlorine-induced corrosion, while lowering the cost of utilitizing alkoxybenzotriazoles alone as corrosion inhibitors.

Further, the use of the instant admixtures allows for intermittent feed to the cooling system being treated, which provides benefits relative to ease of monitoring and environmental impact, while lowering the average inhibitor requirement.

The faster rate of passivation also allows operators more flexibility in providing the contact required to form a durable film, and the ability to passivate in high-solids, particularly high dissolved solids, waters extends the range of water qualities in which alkoxybenzotriazole inhibitors can be used.

The instant inventors have also found that the instant alkoxybenzotriazole compositions de-activate soluble copper ions, which prevents the galvanic deposition of copper which concommitantly occurs with the galvanic dissolution of iron or aluminum in the presence of copper ions. This reduces aluminum and iron corrosion. These compositions also indirectly limit the above galvanic reaction by preventing the formation of soluble copper ions due to the corrosion of copper and copper alloys.

Any alkoxybenzotriazole compound having the following structure can be used:

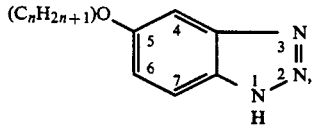

wherein n is greater than or equal to 3 and less than or equal to 12. Salts of such compounds may also be used.

Isomers of the above described alkoxybenzotriazoles can also be used as component a). The 5 and 6 isomers are interchangeable by a simple prototropic shift of the 1 position hydrogen to the 3 position and are believed to be functionally equivalent. The 4 and 7 isomers are believed to function as well as or better than the 5 or 6 isomers, though they are generally more difficult and expensive to manufacture. As used herein, the term "alkoxybenzotriazoles" is intended to mean 5-alkoxy benzotriazoles and 4,6 and 7 position isomers thereof, wherein the alkyl chain length is greater than or equal to 3 but less than or equal to 12 carbons, branched or straight, preferably straight. Compositions containing straight chain alkoxybenzotriazoles are believed to provide more persistent films in the presence of chlorine.

The preferred alkoxybenzotriazoles are sodium salts of $C_5$–$C_8$ alkoxybenzotriazoles, and the most preferred alkoxybenzotriazoles are pentyloxybenzotiazole, sodium salt, and the sodium salt of hexyloxybenzotriazole.

Component b) of the instant compositions is a compound selected from the group consisting of mercaptobenzothiazole (MBT) and salts thereof, preferably sodium and potassium salts of MBT, tolyltriazole (TT) and salts thereof, preferably sodium and potassium salts of TT, benzotriazole (BT) and salts thereof, substituted benzotriazoles, such as chlorobenzotriazole and nitrobenzotriazole, and salts thereof preferably sodium and potassium salts thereof, 1-phenyl-5-mercaptotetrazole (PMT), isomers of PMT, including tautomeric isomers such as 1-phenyl-5 tetrazolinthione and positional isomers such as 2-phenyl-5-mercaptotetrazole and its tautomers, substituted phenyl mercaptotetrazoles, wherein phenyl is $C_1$–$C_{12}$ (straight or branched) alkyl-, $C_1$–$C_{12}$ (straight or branched), alkoxy-, nitro-, halide-, sulfonamido- or carboxyamido substituted, and salts of the above mercaptotetrazoles, preferably the sodium salt. TT and MBT or salts thereof are preferred, and TT is most preferred. The ratio, by weight, of component a):b) should range from about 0.001:100 to about 100:1, preferably from about 0.1:20 to about 20:1, and most preferably from about 0.1:10 to about 10:1.

An effective amount of the instant alkoxybenzotriazole compositions should be used. As used herein, the term "effective amount" relative to the instant compositions refers to that amount of an instant composition, on an active basis, which effectively inhibits metal corrosion to the desired degree in a given aqueous system. Preferably, the instant compositions are added at an active concentration of at least 0.1 ppm, more preferably about 0.1 to about 500 ppm, and most preferably about 0.5 to about 100 ppm, based on the total weight of the water in the aqueous system being treated.

Maximum concentrations of the instant compositions are determined by the economic considerations of the particular application. The maximum economic concentration will generally be determined by the cost of alternative treatments of comparable effectivenesses, if comparable treatments are available. Cost factors include, but are not limited to, the total through-put of system being treated, the costs of treating or disposing of the discharge, inventory costs, feed-equipment costs, and monitoring costs. On the other hand, minimum concentrations are determined by operating conditions such as pH, dissolved solids and temperature.

Further, compositions comprising a copper corrosion inhibiting compound selected from the group consisting of tolyltriazole, benzotriazole, substituted benzotriazoles, phenyl mercaptotetrazoles, substituted phenyl mercaptotetrazoles, mercaptobenzothiazole, and salts thereof and an effective amount of an alkoxybenzotriazole, preferably at least about 0.001 part alkoxybenzotriazole per 100 parts of said copper corrosion inhibiting compound, can be used. The instant inventors have discovered that the performance of corrosion inhibiting compounds such as TT, BT, substituted benzotriazoles MBT, PMT, phenyl-substituted PMT and salts thereof is greatly enhanced by the presence of very small quantities of alkoxybenzotriazole. Thus, an effective amount (for the purpose of improving the film persistence, the passivation rate, the high dissolved solids performance and/or the overall effectiveness of an inhibitor such as TT) of an alkoxybenzotriazole such as hexyloxybenzotriazole greatly improves the efficacy of conventional copper corrosion inhibitors. While virtually any amount of an alkoxybenzotriazole helps, a preferred amount is at least about 0.001 part alkoxybenzotriazole per 100 parts corrosion inhibitor. More preferably, the weight ratio of alkoxybenzotriazole:corrosion inhibitor ranges from about 0.001:1 to about 100:1.

A composition which is exemplary of the best mode comprises the sodium salt of hexyloxybenzotriazole and the sodium salt of tolyltriazole, wherein the weight ratio of these components is about 1:1. This composition would then be added in an amount effective to achieve the desired corrosion inhibition for a given system to be treated. The actual dosage would depend upon the chemistry of the system to be treated, the treatment specification, the type of metal to be protected and other factors. One skilled in the art would easily be able to determine the optimal dosage for a given system.

The alkoxybenzotriazoles of the instant invention may be prepared by any known method. For example, the instant alkoxybenzotriazoles may be prepared by contacting a 4-alkoxy-1, 2-diaminobenzene with an aqueous solution of sodium nitrite in the presence of an acid, e.g., sulfuric acid, and then separating the resultant oily product from the aqueous solution. The 4-alkoxy-1,2-diaminobenzene may be obtained from any number of sources. Also, see U.S. Pat. No. 2,861,078, which discusses the synthesis of alkoxybenzotriazoles.

Several compounds which may be used as component (b) are commercially available. For example, tolyltriazole and benzotriazole are commercially available from PMC, Inc. MBT is commercially available from 1) Uniroyal Chemical Co., Inc. or 2) Monsanto, and PMT is commercially available from 1) Fairmount Chemical Co., Inc., 2) Aceto Corporation and 3) Triple Crown America, Inc. Generally, TT and MBT are sold as sodium salts.

The instant compositions may be prepared by simply blending the constituent compounds. Suitable preparation techniques are well known in the art of water treatment and by suppliers of triazoles. For example, aqueous solutions may be made by blending the solid ingredients into water containing an alkali salt like sodium hydroxide or potassium hydroxide; solid mixtures may be made by blending the powders by standard means; and organic solutions may be made by dissolving the solid inhibitors in appropriate organic solvents. Alcohols, glycols, ketones and aromatics, among others, represent classes of appropriate solvents.

The instant method may be practiced by adding the constituent compounds simultaneously (as a single composition), or by adding them separately, whichever is more convenient. Suitable methods of addition are well known in the art of water treatment. Order-of-addition is not believed to be critical.

The instant compositions can be used as water treatment additives for industrial cooling water systems, gas scrubber systems or any water system which is in contact with a metallic surface, particularly surfaces containing copper and/or copper alloys. They can be fed alone or as part of a treatment package which includes, but is not limited to, biocides, scale inhibitors, dispersants, defoamers and/or other corrosion inhibitors. Also, the instant alkoxybenzotriazole compositions can be fed intermittently or continuously.

Treatment of cooling water which contacts copper or copper alloy surfaces, such as admiralty brass of 90/10 copper-nickel, requires the use of specific copper inhibitors. These inhibitors:

1. minimize the corrosion of the copper or copper alloy surfaces, including general corrosion, dealloying and galvanic corrosion; and 2. minimize problems of galvanic "plating-out" of soluble copper ions onto iron or aluminum. Thus, soluble copper ions can enhance the corrosion of iron and/or aluminum components in contact with aqueous systems. This occurs through the reduction of copper ions by iron or aluminum metal, which is concommitantly oxidized, resulting in the "plating-out" of copper metal onto the iron surface. This chemical reaction not only destroys the iron or aluminum protective film but creates local galvanic cells which can cause pitting corrosion of iron or aluminum.

While conventional copper inhibitors such as tolyltriazole, benzotriazole, and mercaptobenzothiazole, which are used in the instant compositions, are commonly used alone as copper inhibitors in aqueous systems, they are generally fed continuously because of the limited durability of their protective films.

The requirement for continuous feed generally makes it uneconomical to apply these conventional inhibitors to once-through systems or systems with high blowdown rates. Additionally, conventional inhibitors provide only limited protection against chlorine induced corrosion.

While 5-(lower alkyl)benzotriazoles are known which do not require continuous feeding in order to inhibit copper corrosion (see U.S. Pat. No. 4,744,950), these compounds provide relatively poor performance in the presence of chlorine, and may be ineffective in high-solids waters.

These deficiencies are generally overcome by the instant compositions. It is therefore an object of the instant invention to provide inhibitors which produce more chlorine resistant protective films, and which are effective in high-solids, particularly high dissolved solids, aggressive waters.

These objects are achieved through the use of the instant alkoxybenzotriazole/TT, BT, MBT or PMT compositions, which quickly provide protective, durable films on metallic surfaces, especially copper and copper alloy surfaces. These compositions are especially effective in the presence of oxidizing biocides such as chlorine and bromine biocides and/or high solids.

Further, the instant compositions allow the use of an intermittent feed to cooling water systems. Depending on water aggressiveness, the time between feedings may range from several days to months. This results in an average lower inhibitor requirement and provides advantages relative to waste treatment and environmental impact.

EXAMPLES

The following examples demonstrate the effectiveness of the instant compositions as copper and copper alloy corrosion inhibitors. They are not, however, intended to limit the scope of the invention in any way.

EXAMPLE 1

Pentyloxybenzotriazole and Tolyltriazole

The test cell used consisted of an 8-liter vessel fitted with a stirrer, an air dispersion tube, a heater-temperature regulator, and a pH control device. The temperature was regulated at 50±2° C. The pH was automatically controlled by the addition of 1% sulfuric acid or 1% sodium hydroxide solutions to maintain the designated pH. Air was continually sparged into the cell to maintain air saturation. Water lost by evaporation was replenished by deionized water as needed.

Corrosion rates were determined in two (2) distinct waters. The compositions of the test waters used in Example 1 are shown in Table I. Hydroxyethylidenediphosphonic acid (HEDP) was added at a dosage of 0.5 mg/L, on an active basis, to the water to prevent calcium carbonate precipitation during the test.

TABLE I

| Water Compositions used in Example 1 | | |
|---|---|---|
| Water Designation | Ion | Concentration (mg/L) |
| A | Ca | 563 |
| | Mg | 250 |
| | Cl | 1000 |
| | $SO_4$ | 1000 |
| B | Ca | 260 |
| | Mg | 115 |
| | Cl | 467 |
| | $SO_4$ | 460 |

Corrosion rates were determined by weight loss measurements using ½"×3" coupons of various metallurgies after immersion for 48 hours in the test waters. The compositions of the alloys tested are shown in Table II.

Thus, coupons of the specified alloys were prepared according to ASTM Standard G-1 and then placed in the desired corrosion water at the indicated pH and 50° C. The initial test water contained either 5 ppm of pentyloxygenzotriazole or a mixture of 2.5 ppm pentyloxybenzotriazole plus 2.5 ppm tolyltriazole. The specimens remained in the test solutions for 48 hours. They were then removed, rinsed in deionized water, and placed in inhibitor-free water of the same composition under the conditions specified above.

In an effort to synthesize cooling water disinfection, 0.2 mL of sodium bromide solution (made from 11.0 g sodium bromide in 1,000 mL of water) and 0.2 mL of sodium hypochlorite solution (made from 15.0 g Chlorox bleach of 5¼% sodium hypochlorite in 100 mL of water) were added. These additions were made on consecutive working days for a total of ten days. One day after the last addition, the coupons were cleaned and weighed according to the ASTM G-1 procedure. The corrosion rates, as determined by weight loss, are summarized in Table III.

The inhibitor concentration is stated in terms of mg/L of its sodium salt.

TABLE II

| Composition of Copper Alloys (Weight %) | | | |
|---|---|---|---|
| | Alloy (common name) Composition (Wt %) | | |
| Element | C38600 (Copper) | C44300 (Admiralty Brass) | C70600 (90Cu—10Ni) |
| Cu | 99.9 | 72.1 | 87.02 |
| Sn | | 0.9 | |
| Pb | | less than 0.05 | less than 0.01 |
| Fe | | 0.04 | 1.68 |
| As | | 0.05 | — |
| Zn | | Balance | 0.12 |
| Ni | | — | 10.47 |
| Mn | | — | 0.67 |

The corrosion rates of various copper alloys, C38600 (99.9% copper); C70600 (90 Cu-10 Ni), and C44300 (Admiralty brass) were lower for the specimens treated with the mixture of 2.5 ppm TT plus 2.5 ppm POBT than those treated with 5 ppm POBT alone. Especially important is the improved protection provided by the combination in the higher dissolved solids, more aggressive water A, which illustrates the better passivation afforded by the combination in high dissolved-solids waters.

TABLE III

| Comparison of Corrosion Inhibition of 5 ppm Pentyloxybenzotriazole With a Mixture of 2.5 ppm Pentyloxybenzotriazole and 2.5 ppm Tolyltriazole Corrosion Rates in mpy (% Inhibitor Efficiency) | | | | | | | |
|---|---|---|---|---|---|---|---|
| Water | Alloy | pH | Control | 5 POBT (5 ppm) | (% IE)** | (2.5 ppm/2.5 ppm) POBT/TT | (% IE)** |
| A | C38600 | 7 | 2.59 | 5.75 | (0) | 0.35 | (86) |
| | (Copper) | 7.5 | 2.8 | 4.18 | (0) | 0.68 | (76) |
| | | 8 | 1.2 | 0.31 | (75) | 0.11 | (92) |
| | | 8.5 | 0.51 | 0.15 | (71) | 0.07 | (86) |
| | C70600 | 7 | 2.66 | 3.81 | (0) | 0.8 | (70) |
| | (90Cu—10Ni) | 7.5 | 2.77 | 3.52 | (0) | 0.94 | (66) |
| | | 8 | 1.11 | 0.57 | (49) | 0.14 | (87) |
| | | 8.5 | 0.73 | 0.19 | (74) | 0.07 | (90) |
| | C44300 | 7 | 3.9 | 3.72 | (5) | 1.28 | (67) |
| | (Admiralty | 7.5 | 4.55 | 3.7 | (19) | 1.28 | (72) |
| | Brass) | 8 | 1.66 | 1.47 | (11) | 0.33 | (80) |
| | | 8.5 | 0.7 | 0.59 | (16) | 0.26 | (63) |
| B | C44300 | 7 | 5.2 | 3.6 | (30) | 0.53 | (90) |
| | (Admiralty | 7.5 | 3.24 | 1.9 | (41) | 0.12 | (96) |
| | Brass) | 8 | 0.7 | 0.21 | (70) | 0.33 | (53) |
| | | 8.5 | 0.19 | 0.08 | (58) | 0.04 | (79) |
| | C38600 | 7 | 5 | 1.2 | (76) | 0.2 | (96) |
| | (Copper) | 7.5 | 1.69 | 2.78 | (0) | 0.11 | (93) |
| | | 8 | 0.45 | 0.17 | (62) | 0.13 | (71) |
| | | 8.5 | 0.34 | 0.08 | (76) | 0.04 | (88) |
| | C70600 | 7 | 4.2 | 1.6 | (62) | 0.74 | (82) |
| | (90Cu—10Ni) | 7.5 | 1.92 | 2.1 | (0) | 0.27 | (86) |
| | | 8 | 0.8 | 0.27 | (66) | 0.28 | (65) |
| | | 8.5 | 0.55 | 0.2 | (64) | 0.17 | (69) |

$$**\% \text{ IE} = \frac{\text{Control} - \text{Sample}}{\text{Control}} \times 100\%$$

EXAMPLE 2

Hexyloxybenzotriazole and Tolyltriazole

This example shows the benefits in terms of corrosion rates of utilizing hexyloxybenzotriazole (HOBT) in combination with tolyltriazole. The test procedure of Example 1 was used. Results are shown in Table IV.

These results show that the combination of HOBT/TT is more efficient in the higher dissolved solids water, water A, than HOBT alone.

TABLE IV

Comparison of Corrosion Rates Obtained With 5 ppm of Hexyloxybenzotriazole Compared to Those Obtained With a Mixture of 2.5 ppm Hexyloxybenzotriazole Plus 2.5 ppm Tolyltriazole

| Alloy | pH | 5 mg/L HOBT | 2.5 mg/L HOBT/ 2.5 mg/L NaTT | Control (No Inhibitor) |
|---|---|---|---|---|
| | | Water A | | |
| C38600 | 7.5 | 3.40 | 0.36 | 2.8 |
| (Copper) | 8.5 | 0.27 | 0.17 | 0.5 |
| C70600 | 7.5 | 3.08 | 1.27 | 2.8 |
| (90Cu—10Ni) | 8.5 | 0.60 | 0.32 | 0.7 |
| C44300 | 7.5 | 4.49 | 0.31 | 4.6 |
| (Admiralty) | 8.5 | 0.34 | 0.18 | 0.7 |
| | | Water B | | |
| C38600 | 7.5 | 0.25 | 0.16 | 1.7 |
| (Copper) | 8.5 | 0.15 | 0.19 | 0.3 |
| C70600 | 7.5 | 0.28 | 0.25 | 1.9 |
| (90Cu—10Ni) | 8.5 | 0.18 | 0.11 | 0.6 |
| C44300 | 7.5 | 2.5 | 0.11 | 3.2 |
| (Admiralty) | 8.5 | 0.10 | 0.14 | 0.2 |

TABLE V

Composition of Corrosive Water used in Example 3

| Ion | Conc. (mg/L) |
|---|---|
| Ca | 260 |
| Mg | 115 |
| Cl | 467 |
| $SO_4$ | 460 |
| pH | 7.5 |

EXAMPLE 3

Pentyloxybenzotriazole

This example illustrates the improvement in performance given by pentyloxybenzotriazole and hexyloxybenzotriazole in combination with tolyltriazole compared to pentyloxybenzotriazole or hexyloxybenzotriazole alone. The test apparatus consisted of a dynamic flow system with an 8L reservoir fitted with regulating heater/circulator, aerator, and pH control. The test water described in Table V was pumped through an admiralty brass (Alloy C38600) tube 8 inches long and ¾" diameter. The tube was fitted with a resistance heater 4 inches in length, coiled to fit snugly around the tube. The flow through the tube and the power to the heating element were controlled to allow a heat flux of 10,000 Btu/ft$^2$/hr and a temperature differentiatial of 1° F.

The heated specimens were passivated for 24 hours in inhibited water at pH 7.5, and 50° C. Then the water was changed to inhibitor-free water and chlorine was added at 1 ppm and allowed to remain in contact with the coupon being tested for 1 hour. The water was then changed to chlorine-free, inhibitor-free water until the next day. The cycle was repeated for a total of five chlorinations. The result is shown in Table VI.

These results show the improved inhibition of a heat-rejecting surface afforded by the combination of the alkoxybenzotraizoles plus TT compared to that afforded by a higher concentration of the alkoxybenzotriazoles alone. The benefit of the combination is especially striking for HOBT and TT.

TABLE VI

Corrosion Rates on Heat-Rejecting C38600 (Admiralty Brass) Tubes

| Inhibitor | Pre-Treatment Concentration mg/L | Heated-Tube Weight-Loss (mpy) |
|---|---|---|
| POBT | 3 | 0.5 |
| POBT | 5 | 0.4 |
| POBT/TT | 3/3 | 0.3 |
| HOBT | 5 | 3.3 |
| HOBT/TT | 3/3 | 0.2 |
| Control (no inhibitor) | 0 | 3.5 |

What is claimed is:

1. A composition comprising:

a) a compound having the following formula:

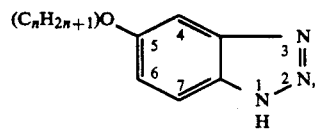

or a salt thereof, wherein n is greater than or equal to 3 and less than or equal to 12; and b) a compound selected from the group consisting of tolyltriazole, benzotriazole, substituted benzotriazole mercaptobenzothiazole, 1-phenyl-5-mercaptotetrazole isomers of 1-phenyl-5-mercaptotetrazole, substituted phenyl mercaptotetrazoles and salts thereof, wherein the weight ratio of a):b) ranges from about 0.01:100 to about 100:1.

2. An aqueous system comprising:

a) a compound having the following formula:

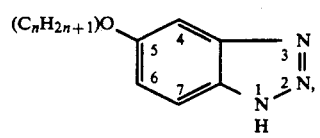

or a salt thereof, wherein n is greater than or equal to 3 and less than or equal to 12; and b) a compound selected from the group consisting of tolyltriazole, benzotriazole, mercaptobenzothiazole, 1-phenyl-5-mercaptotetrazole and salts thereof, wherein the weight ratio of a):b) ranges from about 0.01:100 to about 100:1 and c) water.

3. A composition comprising a copper corrosion inhibitor selected from the group consisting of tolyltriazole, benzotriazole, substituted benzotriazole mercaptobenzothiazole, 1-phenyl-5-mercaptotetrazole, isomers of 1-phenyl-5-mercaptotetrazole, substituted phenyl mercapto-tetrazoles, and salts thereof and an effective amount for the purpose of improving the effectiveness of said copper corrosion inhibitor of a $C_3$ to $C_{12}$ alkoxybenzotriazole or salt thereof.

4. The composition of claim 3, wherein said alkoxybenzotriazole is hexyloxybenzotriazole.

5. The composition of claim 4, wherein said copper corrosion inhibitor is selected from the group consisting of tolyltriazole and salts thereof, and wherein said composition contains at least about 0.001 part hexyloxybenzotriazole per 100 parts tolyltriazole.

* * * * *